US005911781A

United States Patent [19]

Vidt

[11] Patent Number: 5,911,781

[45] Date of Patent: Jun. 15, 1999

[54] INTEGRAL COILER FURNACE DRIVE MOTOR

[75] Inventor: James R. Vidt, Allison Park, Pa.

[73] Assignee: Tippins Incorporated, Pittsburgh, Pa.

[21] Appl. No.: 08/758,785

[22] Filed: Dec. 2, 1996

[51] Int. Cl.[6] ..... B21B 39/00

[52] U.S. Cl. ..... 72/202; 72/183; 72/229; 242/546

[58] Field of Search ..... 72/148, 128, 202, 72/206, 229, 183; 242/546, 545, 538.2

[56] References Cited

U.S. PATENT DOCUMENTS

| | | | |
|---|---|---|---|
| 1,258,092 | 3/1918 | Clark . | |
| 1,492,954 | 5/1924 | Biggert, Jr. . | |
| 1,644,857 | 10/1927 | Shover | 72/148 |
| 1,918,968 | 7/1933 | Keeney | 72/128 |
| 2,125,660 | 8/1938 | Whalen | 72/148 |
| 3,187,530 | 6/1965 | Ranney | 72/183 |
| 3,621,694 | 11/1971 | Greenberger . | |
| 3,680,804 | 8/1972 | Aaron et al. . | |
| 3,686,919 | 8/1972 | Brusa . | |
| 3,686,921 | 8/1972 | Roper | 72/183 |
| 4,056,961 | 11/1977 | Jamison | 72/148 |
| 4,442,690 | 4/1984 | Hirschmanner et al. | 72/148 |
| 4,508,523 | 4/1985 | Leu . | |
| 4,522,050 | 6/1985 | Thomas | 72/229 |
| 4,657,196 | 4/1987 | Irish et al. . | |
| 4,703,640 | 11/1987 | Buchegger et al. . | |
| 4,964,587 | 10/1990 | Oki et al. . | |
| 5,419,173 | 5/1995 | Baensch et al. . | |
| 5,479,807 | 1/1996 | Moser . | |

FOREIGN PATENT DOCUMENTS

| | | | |
|---|---|---|---|
| 668064 | 3/1952 | United Kingdom | 72/148 |
| 1102631 | 2/1968 | United Kingdom | 72/148 |

*Primary Examiner*—Daniel C. Crane
*Attorney, Agent, or Firm*—Webb Ziesenheim Bruening Logsdon Orkin & Hanson, P.C.

[57] ABSTRACT

A hot strip mill for reducing metal strip product as the metal strip product is moved through the mill along a pass line includes at least one coiler furnace on one side of the pass line. Each coiler furnace has a coiling unit selectively receiving a strip product from the pass line and at least one drive motor coupled to the coiling unit for rotatably driving the coiling unit. Each drive motor is positioned on the same side of the pass line as the coiler furnace. The drive motor can be easily mounted on a drive motor support above a roller table for the hot strip mill. The drive motor support may be formed as a thermal barrier between the drive motor and the roller table. The present arrangement avoids redesign of the motor room of an existing mill.

17 Claims, 4 Drawing Sheets

INTEGRAL COILER FURNACE DRIVE MOTOR

BACKGROUND OF THE INVENTION

1. Field of the Invention

The present invention relates to a hot strip mill for reducing metal strip products. More specifically, the present invention relates to a drive motor assembly for a coiler furnace of a hot strip mill.

2. Prior Art

Existing plate mills have been converted to coil plate facilities for rolling metal strip products by adding at least one coiler furnace on one side of a reversing mill. Typically, at least one coiler furnace is provided on the upstream side of the reversing mill and at least one coiler furnace is provided on the downstream side of the reversing mill. When converting a plate mill to a coil plate facility, each added coiler furnace is normally driven by a drive motor which is placed in the motor room of the rolling mill. A spindle shaft and gear drive extend between the motor and the mandrel, or coiling unit, of the coiler furnace. The difficulty exists in that the motor rooms in existing mills are not engineered to add additional drive motors without significant modification to the existing equipment and to the existing motor room. These extensive modifications result in prolonged shutdown of the mill during conversion, adding significant additional costs. Furthermore, the area surrounding the motor room may not easily accommodate the changes necessary such that a conventional retrofitting system would not be available for the mill.

It is an object of the present invention to overcome the aforementioned drawbacks of the prior art. It is a further object of the present invention to provide a drive motor assembly for a coiling unit for metal strip product which avoids the aforementioned difficulties in retrofitting existing plate mills. It is a further object of the present invention to provide a drive motor assembly for a coiling unit for metal strip products which minimizes conversion costs and shutdown of the mill during the conversion process of an existing mill.

SUMMARY OF THE INVENTION

The objects of the present invention are achieved by providing a drive motor assembly for a coiling unit for strip product according to the present invention. A drive motor assembly of the present invention includes a drive motor support mounted adjacent the coiling unit on the same elevational side of a pass line as the coiling unit. A drive motor is mounted on the drive motor support, and a drive transmission is coupled to the drive motor and to the coiling unit.

The present invention also provides a hot strip mill design including a mill for reducing strip product as the strip product is moved through the mill along the pass line, a roller table for supporting the strip product along the pass line, and at least one coiler furnace positioned on one side of the pass line. Each coiler furnace has a coiling unit selectively receiving the strip product from the pass line and at least one drive motor coupled to the coiling unit. Each drive motor is positioned on the same elevational side of the pass line as the coiler furnace. The drive motor may be mounted on a drive support above the roller table. The drive motor may be mounted either parallel to or perpendicular to the coiling unit or mandrel of the coiler furnace.

The present invention additionally includes a method of retrofitting an existing rolling mill having a reversing mill for reducing metal product traveling through the reversing mill on a pass line. The method of the present invention includes the steps of installing at least one coiler furnace in the rolling mill on one side of the pass line with each coiler furnace including a coiling unit or mandrel for selectively receiving metal strip product from the pass line. At least one drive motor is installed in the rolling mill with each drive motor driving one coiling unit of a coiler furnace and positioned on the same side of the pass line as the coiler furnace.

These and other advantages of the present invention will be clarified in the description of the preferred embodiments taken together with the attached figures, wherein like reference numerals represent like elements throughout.

DESCRIPTION OF THE PREFERRED EMBODIMENTS

Figure 1:
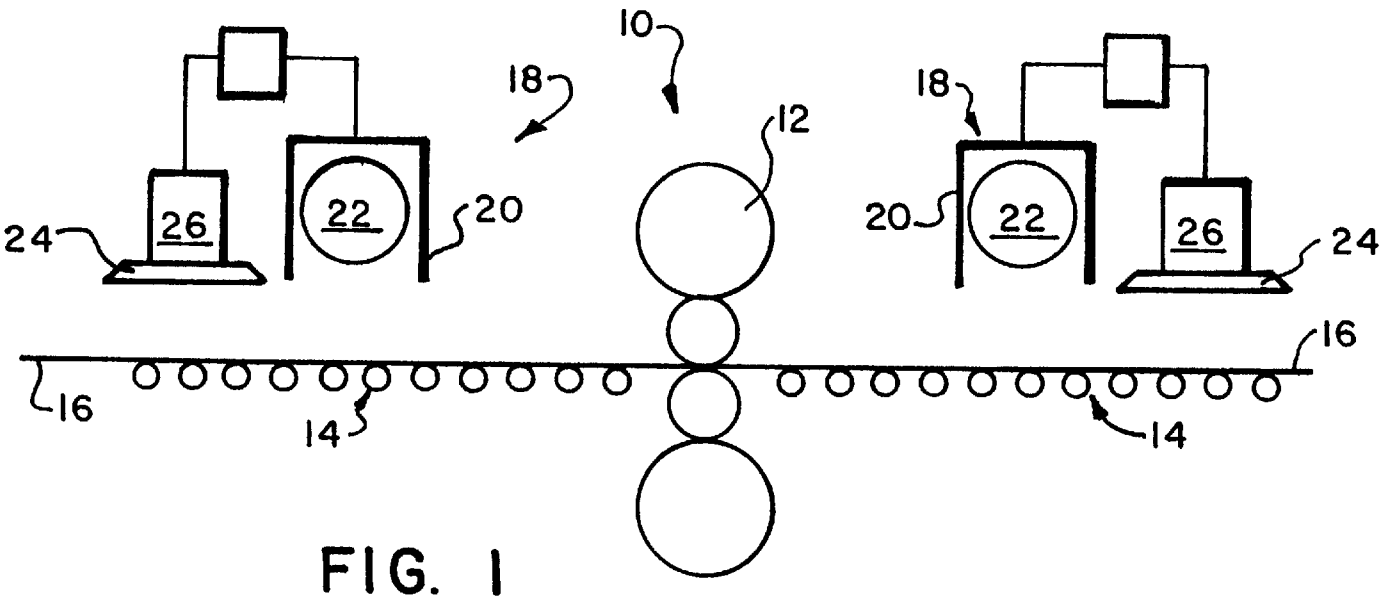
FIG. 1 schematically illustrates a hot strip mill according to the present invention.

FIG. 1 illustrates a layout for a hot strip mill 10 according to the present invention. The mill 10 includes a reversing mill 12 for reducing metal strip product, particularly steel, aluminum or brass, as the metal strip product is moved back and forth through the rollers of the reversing mill 12. The metal strip product is supported on rollers of a roller table 14 along a pass line 16 defined by the roller table 14.

A four-high reversing rolling mill 12 is schematically illustrated in FIG. 1 comprised of a pair of backup rolls and a pair of work rolls engaging the strip product. A pair of reversing mills 12 to operate alone or in tandem may also be utilized in accordance with the present invention as well as two-high reversing mills and the like.

A coiler furnace assembly 18 is positioned above the pass line 16 both before and after the reversing mill 12. Each coiler furnace assembly 18 includes a furnace housing 20 positioned above the roller table 14 and pass line 16. Each coiler furnace assembly 18 includes a mandrel or coiling unit 22 for selectively receiving the strip product thereon within the furnace housing 20. The coiler furnace assemblies 18 generally operate as follows. The metal strip product is passed back and forth through the reversing mill 12 until it is reduced to a thickness capable of being coiled, generally on the order of about one inch or less. The strip product is then rotatably received on one of the coiling units 22 of a coiler furnace assembly 18. The strip product is passed from one coiling unit 22 through the reversing mill 12 to the other coiling unit 22 on the opposite side of reversing mill 12. The strip product is passed back and forth through the reversing mill 12 between the coiler furnace assemblies 18 until it is reduced to a final product thickness.

The coiler furnace assemblies 18 are illustrated as being positioned above the roller table 14 and pass line 16 and are shown in greater detail in FIGS. 2–5. The coiler furnace assemblies 18 may be positioned below the pass line 16 and roller table 14. Additionally, multiple coiler furnace assemblies 18 may be provided on one side of the reversing mill 12. Providing a pair of coiler furnace assemblies 18 on the downstream side of the reversing mill 12 allows one of the coiler furnace assemblies 18 to be utilized for paying out of the finished strip product for subsequent downstream processing while the remaining coiler furnace assemblies 18 of the hot strip mill 10 are being utilized for reducing strip product. A pair of coiler furnace assemblies 18 may analogously be positioned on an upstream side of the reversing mill 12 with one coiler furnace assembly 18 being used to receive the strip product, such as from a thin strip caster. The remaining coiler furnace assemblies 18 may be utilized for reducing the metal strip product. An additional alternative arrangement would simply be to utilize a single coiler furnace assembly 18 mounted on an upstream side of the reversing mill 12. When only a single coiler furnace assembly 18 is utilized, the anticipated rolling procedure operates as follows: The products will be flat passed through the reversing mill 12 until the penultimate pass upon which it is passed through the reversing mill 12 and received within the single coiler furnace assembly 18. The strip product is then passed out of the single coiler furnace assembly 18 through the reversing mill 12 while it is being reduced to the final product thickness. The product which has been reduced to the final product thickness will be passed by the roller table 14 to subsequent downstream processing (not shown). From the foregoing, it should be evident that a wide variety of configurations of the number and positioning of the coiler furnace assemblies 18 is available within the scope of the present invention.

The present invention relates to providing a drive motor assembly for each coiling unit 22 of the coiler furnace assemblies 18. The drive motor assembly includes a drive motor support 24 mounted adjacent the coiling unit 22 on the same elevational side of the pass line 16 as the furnace housing 20 and coiling unit 22. A drive motor 26 is mounted on the drive motor support 24. Cooling air, if needed, can be directed to the drive motor from the motor room (not shown) or the like. The drive motor support 24 is intended to be a thermal barrier for the drive motor 26. The thermal barrier may be needed to protect the drive motor 26 from the heat associated with hot rolling of metal strip product. To provide an appropriate thermal barrier, the drive motor support 24 may be internally cooled with cooling fluid supplied from an external source (not shown).

Figure 2:
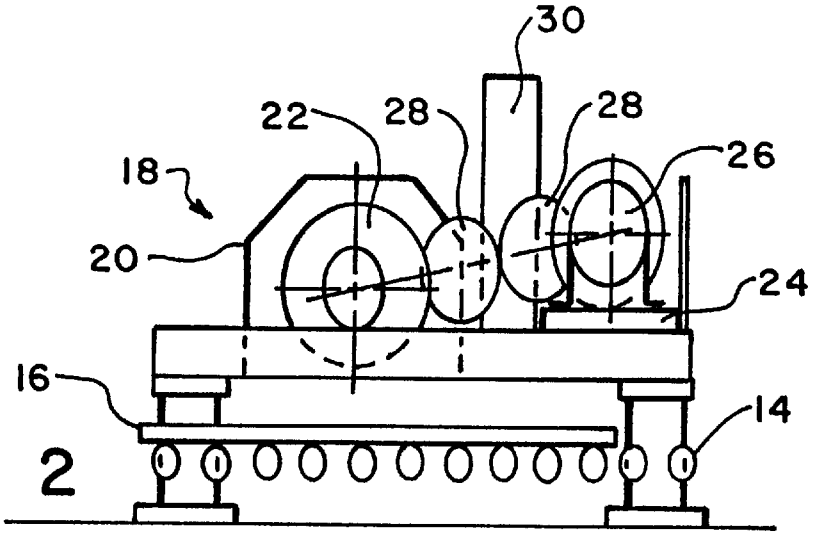
FIG. 2 schematically illustrates a side view of a coiler furnace assembly utilized in the hot strip mill of FIG. 1.
Figure 3:
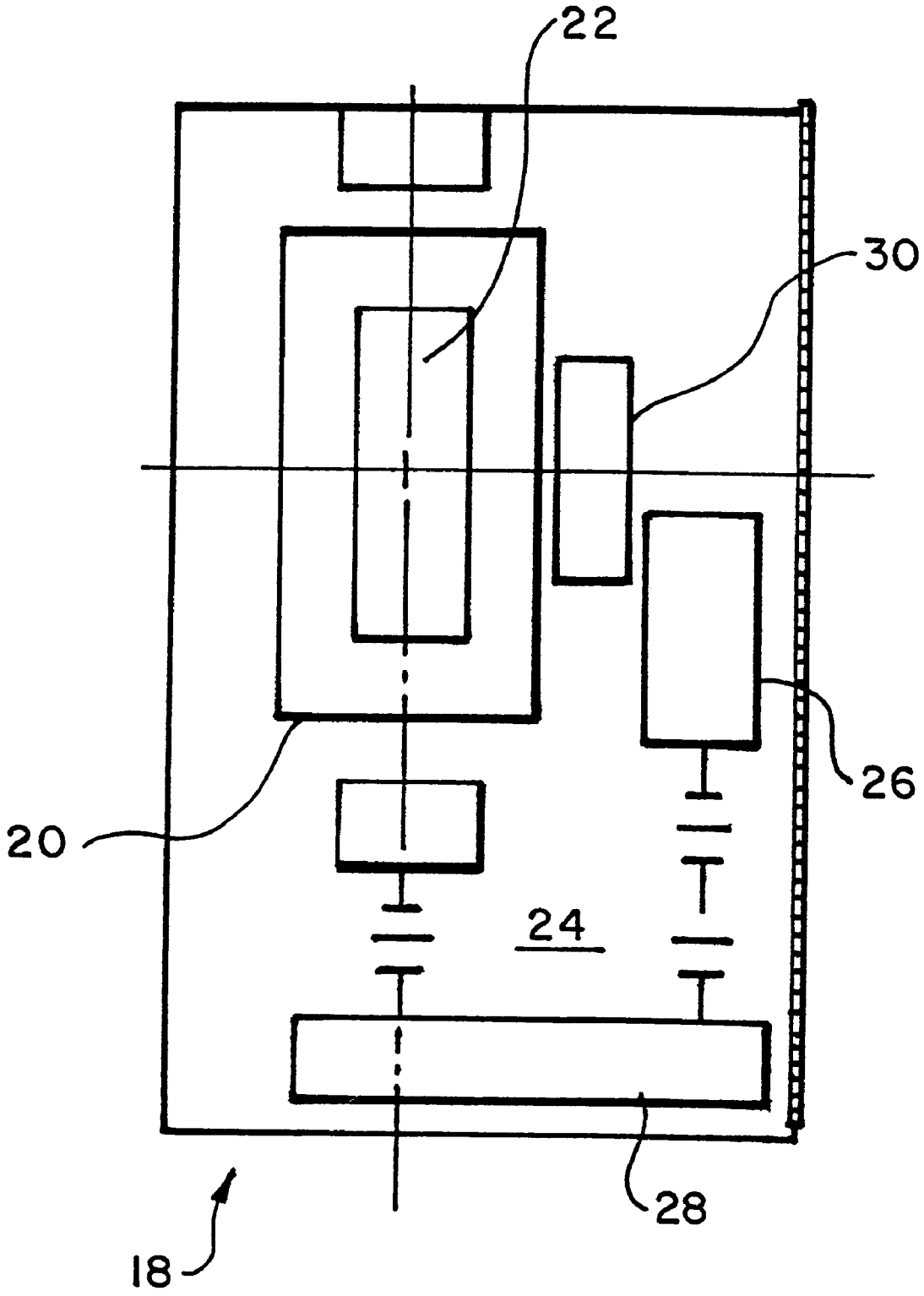
FIG. 3 is a plan view schematically illustrating the coiler furnace assembly of FIG. 2.
Figure 4:
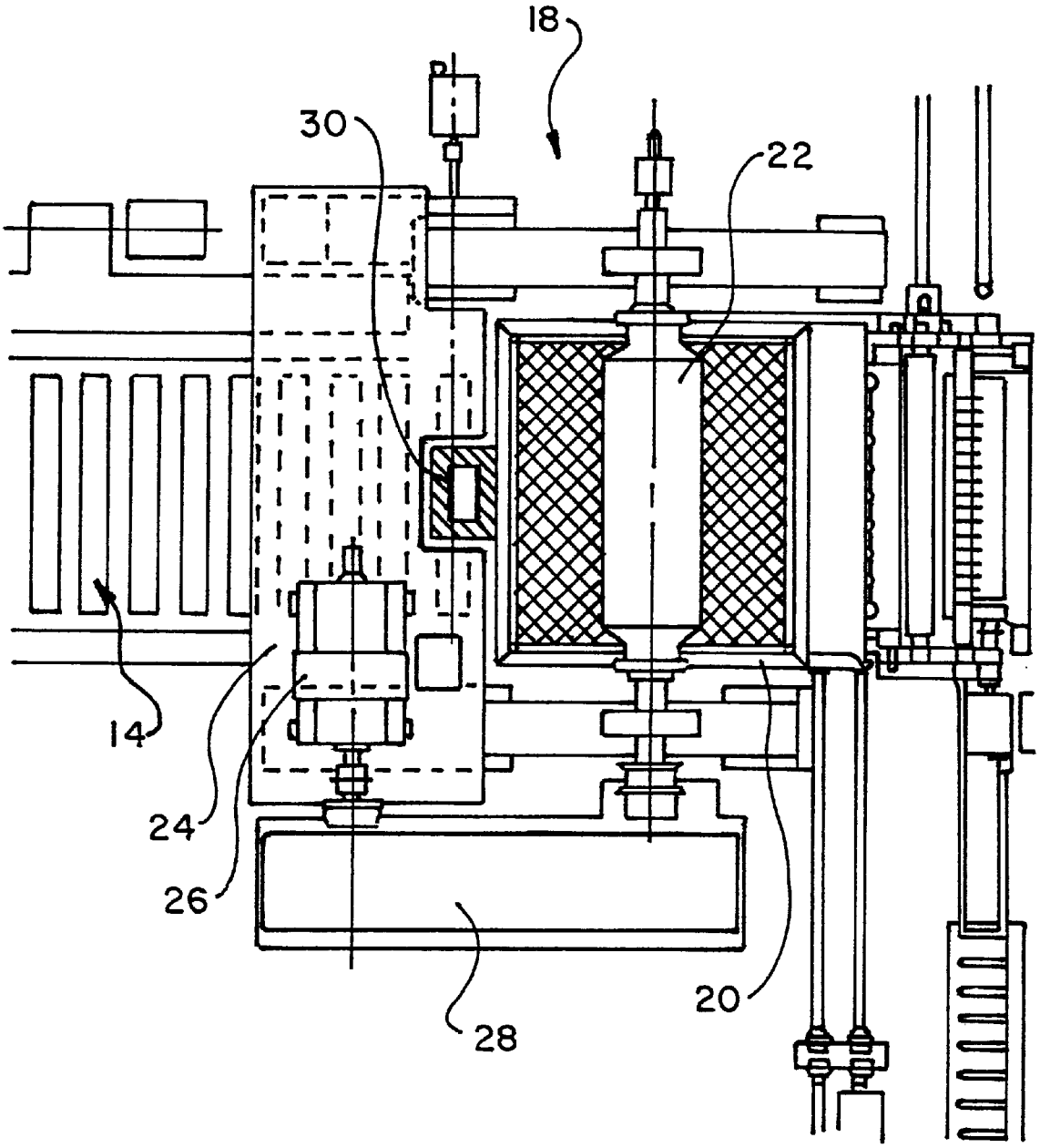
FIG. 4 is a plan view of the coiler furnace assembly for use in the hot strip mill illustrated in FIG. 1.
Figure 5:
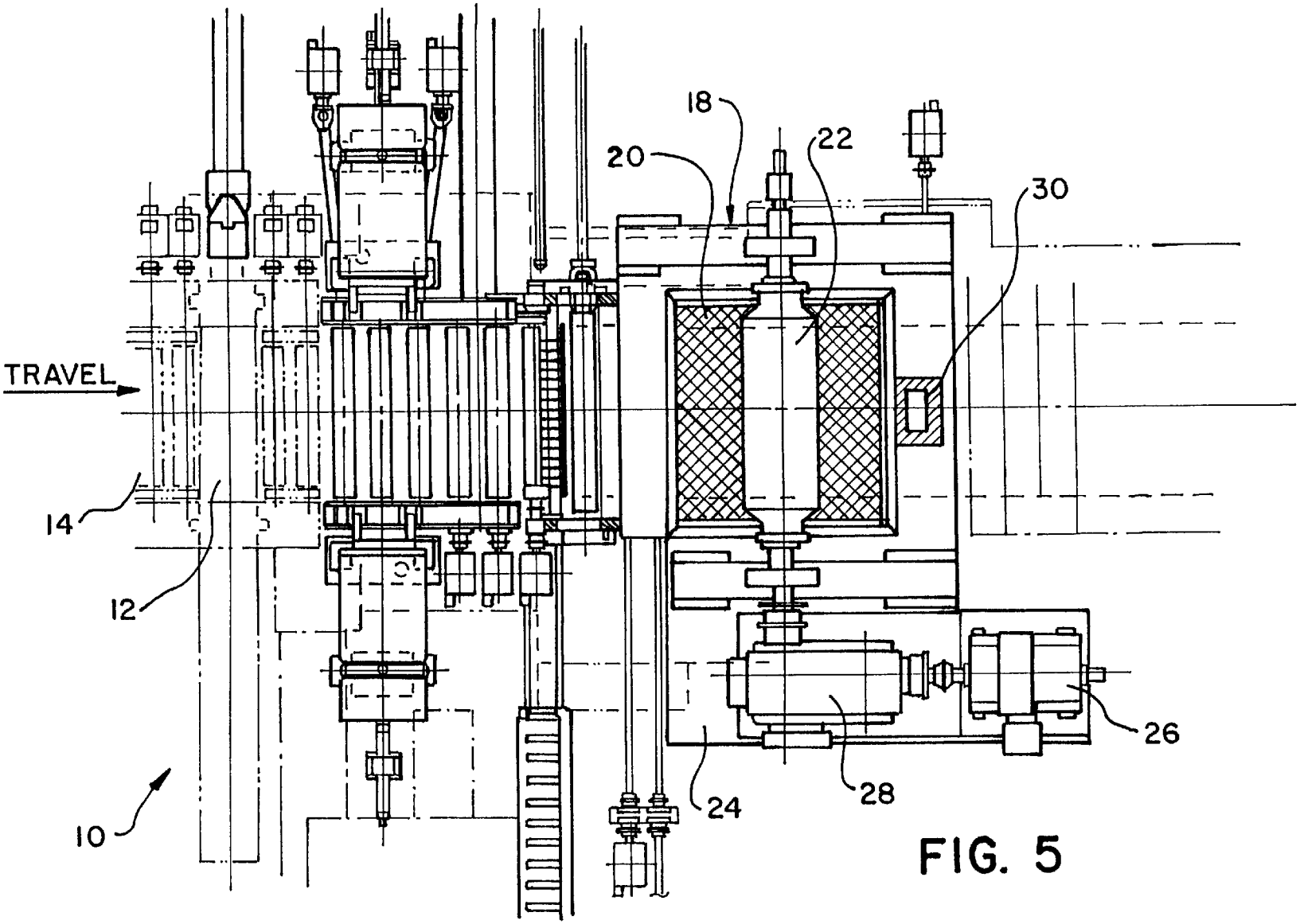
FIG. 5 is a top plan view of a modified coiler furnace assembly for use in the hot strip mill of FIG. 1.

A drive transmission 28 is coupled to the drive motor 26 and to the mandrel or coiling unit 22 to transmit the drive from the drive motor 26 to the coiling unit 22. The drive transmission 28 may be formed to have the desired reduction or may connect the drive motor 26 to the coiling unit 22 through idler gearing. The drive transmission 28 will allow the axis of the drive motor 26 to be positioned substantially parallel to the axis of the coiling unit 22 as shown in FIGS. 2–4 or, alternatively, be positioned at a right angle to the axis of the coiling unit 22 as shown in the configuration of FIG. 5. The drive transmission 28 can be constructed to orientate the axis of the drive motor 26 at any required angle relative to the coiling unit 22. The space availability in the mill will essentially govern where the motor 26 is positioned relative to the adjacent coiling unit 22. As shown in FIGS. 3 and 4, when mounting the drive motor 26 substantially parallel to the axis of the coiling unit 22, the drive motor support 24 and associated drive motor 26 can be positioned directly vertically over the roller table 14. The drive motor support 24 will be positioned immediately adjacent the furnace housing 20 and allows appropriate space for the flue 30 of the coiler furnace assembly 18.

The design of the present hot strip mill 10 allows for a simple method for retrofitting an existing plate mill into the hot strip mill 10 of the present invention. In a plate mill having a reversing mill 12 for reducing metal products traveling through the reversing mill 12 along a pass line 16 on roller tables 14, the method of the present invention will provide the steps of: (1) installing a pair of coiler furnace assemblies 18 in the rolling mill 10 on opposite sides of the reversing mill 12 essentially as illustrated in FIG. 1; (2) the drive motors 26 for the coiler furnace assemblies 18 can be installed in one of the configurations illustrated in FIGS. 2–5, wherein the drive motors 26 are positioned adjacent the coiler furnace assembly 18 on the same side of the pass line 16 as the coiler furnace assembly 18; and (3) the axis of the drive motor 26 can be located relative to the axis of the coiling unit 22 depending on the available room in the existing rolling mill.

The design of the hot strip mill 10 of the present invention allows for significant advantages and retrofitting an existing plate mill. The present design does not require any modification to the foundation or cable trays in an existing motor room. A significant amount of the work in retrofitting an existing plate mill will be able to be completed while the existing plate mill is in operation, thereby minimizing the downtime for the conversion process. Additionally, the new panels, wiring and controls associated with the added coiler furnaces can be installed without any downtime to the existing mill operation since the existing motor room structure is not affected. However, the present hot strip mill 10, including the various components thereof, can be manufactured and sold as a turnkey system.

It will be apparent to those of ordinary skill in the art that various modifications may be made to the present invention without departing from the spirit and scope thereof. Consequently, the scope of the present invention is intended to be defined by the appended claims.

What is claimed is:

1. A hot strip mill for reducing metal strip products comprising:

a mill for reducing strip products as the strip product is moved through said mill along a pass line;

a roller table supporting the strip product along said pass line;

at least one coiler furnace positioned on one side of said pass line, each said coiler furnace having a coiling unit selectively receiving strip product from said mill; and at least one drive motor, each said drive motor coupled to said coiling unit of one said coiler furnace, said drive motor positioned on a same elevational side of said pass line as said coiler furnace, wherein each said drive motors is positioned vertically above said roller table.

2. The hot strip mill of claim 1 further including a thermal barrier between each said drive motor and said roller table.

3. The hot strip mill of claim 2 further including at least one gear drive, each said gear drive coupled to said drive motor and to said coiling unit.

4. The hot strip mill of claim 1 further including a thermal barrier between each said drive motor and said roller table.

5. A coiler furnace assembly for strip products comprising:

a roller table for supporting the strip product;

a furnace housing positioned on one side of said roller table;

a coiling unit rotatably positioned within said furnace housing, said coiling unit receiving the strip product from said roller table; and a drive motor for driving said coiling unit, said drive motor positioned on the same elevational side of said roller table as said furnace housing, wherein said drive motor is positioned vertically above said roller table.

6. The coiler furnace assembly of claim 5 further including a thermal barrier between said drive motor and said roller table.

7. The coiler furnace assembly of claim 5 further including at least one gear drive, said gear drive coupled to said drive motor and to said coiling unit.

8. A drive motor assembly for a coiling unit for metal strip products moving along a pass line along a roller table, said drive motor assembly comprising:

a drive motor support mounted adjacent the coiling unit on the same elevational side of said pass line as the coiling unit and positioned vertically above said roller table;

a drive motor mounted on said drive motor support; and wherein said drive motor is coupled to the coiling unit.

9. The drive motor assembly of claim 8 wherein said drive motor support includes a thermal barrier for at least one side of said drive motor.

10. The drive motor assembly of claim 8 wherein said drive motor is substantially parallel with the coiling unit.

11. A method of retrofitting an existing rolling mill having a reversing mill for reducing metal product traveling through said reversing mill along a pass line and an existing motor room for said rolling mill, said method comprising the steps of:

installing at least one coiler furnace in said rolling mill on one side of said pass line, each said coiler furnace including a coiling unit for selectively receiving metal strip product from said pass line; and installing at least one drive motor in said rolling mill, each said drive motor driving one said coiling unit of a coiler furnace and positioned on the same elevational side of said pass line as said coiler furnace at a position spaced from said existing motor room of said mill.

12. The method of claim 11 wherein at least two of said coiler furnaces are installed, one on an upstream side of said reversing mill and one on a downstream side of said reversing mill.

13. The method of claim 11 wherein said rolling mill includes a roller table supporting the strip product along said pass line and wherein each said drive motor is positioned vertically above said roller table.

14. The method of claim 13 further including the step of installing a thermal barrier between each said drive motor and said roller table.

15. A coiling assembly for coiling metal strip and product movable on a roller table, said coiling assembly comprising:

a rotatable mandrel receiving the metal strip thereon;

a drive motor support horizontally adjacent said mandrel, said support positioned vertically above said roller table;

a drive motor mounted on said drive motor support wherein said drive motor is horizontally adjacent said mandrel and is coupled to said mandrel.

16. The coiling assembly of claim 15 wherein said drive motor support is formed as a thermal barrier.

17. The coiling assembly of claim 15 wherein said drive motor is mounted substantially parallel to said mandrel.

* * * * *